US006775993B2

(12) United States Patent
Dubé

(10) Patent No.: US 6,775,993 B2
(45) Date of Patent: Aug. 17, 2004

(54) HIGH-SPEED DEFROST REFRIGERATION SYSTEM

(76) Inventor: Serge Dubé, 2595 Du Bourgogne, St-Lazere, Québec (CA), J7T 2C1

( * ) Notice: Subject to any disclaimer, the term of this patent is extended or adjusted under 35 U.S.C. 154(b) by 0 days.

(21) Appl. No.: 10/189,462

(22) Filed: Jul. 8, 2002

(65) Prior Publication Data

US 2004/0003601 A1 Jan. 8, 2004

(51) Int. Cl.[7] ..... F25B 47/02; F25D 21/06
(52) U.S. Cl. ..... 62/81; 62/196.4; 62/278
(58) Field of Search ..... 62/81, 277, 278, 62/503, 196.4

(56) References Cited

U.S. PATENT DOCUMENTS 2,978,877 A * 4/1961 Long ..... 62/55
3,332,251 A * 7/1967 Watkins ..... 62/81
4,167,102 A * 9/1979 Willitts ..... 62/152
4,979,371 A * 12/1990 Larson ..... 62/81
5,319,940 A * 6/1994 Yakaski ..... 62/617
5,673,567 A 10/1997 Dubé
5,887,440 A 3/1999 Dubé
6,089,033 A 7/2000 Dubé

* cited by examiner

*Primary Examiner*—Harry B. Tanner
(74) *Attorney, Agent, or Firm*—Ogilvy Renault

(57) ABSTRACT

A defrost refrigeration system having a main refrigeration system and comprising a first line extending from a compressing stage to an evaporator stage and adapted to receive refrigerant in high-pressure gas state from the compressing stage. A first pressure reducing device on the first line is provided for reducing a pressure of the refrigerant in the high-pressure gas state to a second low-pressure gas state. Valves are provided for stopping a flow of the refrigerant in a first low-pressure liquid state from a condensing stage to evaporators of the evaporator stage and directing a flow of the refrigerant in the second low-pressure gas state to release heat to defrost the evaporators and thereby changing phase at least partially to a second low-pressure liquid state. A second line is provided for directing the refrigerant having released heat to the compressing stage, the condensing stage or the evaporator stage.

8 Claims, 6 Drawing Sheets

HIGH-SPEED DEFROST REFRIGERATION SYSTEM

TECHNICAL FIELD

The present invention relates to a high-speed evaporator defrost system for defrosting refrigeration coils of evaporators in a short period of time without having to increase compressor head pressure.

BACKGROUND ART

In refrigeration systems found in the food industry to refrigerate fresh and frozen foods, it is necessary to defrost the refrigeration coils of the evaporators periodically, as the refrigeration systems working below the freezing point of water are gradually covered by a layer of frost which reduces the efficiency of evaporators. The evaporators become clogged up by the build-up of ice thereon during the refrigeration cycle, whereby the passage of air maintaining the foodstuff refrigerated is obstructed. Exposing foodstuff to warm temperatures during long defrost cycles may have adverse effects on their freshness and quality.

One method known in the prior art for defrosting refrigeration coils uses an air defrost method wherein fans blow warm air against the clogged-up refrigeration coils while refrigerant supply is momentarily stopped from circulating through the coils. The resulting defrost cycles may last up to about 40 minutes, thereby possibly fouling the foodstuff.

In another known method, gas is taken from the top of the reservoir of refrigerant at a temperature ranging from 80° F. to 90° F. and is passed through the refrigeration coils, whereby the latent heat of the gas is used to defrost the refrigeration coils. This also results in a fairly lengthy defrost cycle.

U.S. Pat. No. 5,673,567, issued on Oct. 7, 1997 to the present inventor, discloses a system wherein hot gas from the compressor discharge line is fed to the refrigerant coil by a valve circuit and back into the liquid manifold to mix with the refrigerant liquid. This method of defrost usually takes about 12 minutes for defrosting evaporators associated with open display cases and about 22 minutes for defrosting frozen food enclosures. The compressors are affected by hot gas coming back through the suction header, thereby causing the compressors to overheat. Furthermore, the energy costs increases with the compressor head pressure increase.

U.S. Pat. No. 6,089,033, published on Jul. 18, 2000 to the present inventor, introduces an evaporator defrost system operating at high speed (e.g., 1 to 2 minutes for refrigerated display cases, 4 to 6 minutes for frozen food enclosures) comprising a defrost conduit circuit connected to the discharge line of the compressors and back to the suction header through an auxiliary reservoir capable of storing the entire refrigerant load of the refrigeration system. The auxiliary reservoir is at low pressure and is automatically flushed into the main reservoir when liquid refrigerant accumulates to a predetermined level. The pressure difference between the low pressure auxiliary reservoir and the typical high pressure of the discharge of the compressor creates a rapid flow of hot gas through the evaporator coils, thereby ensuring a quick defrost of the refrigeration coils. Furthermore, the suction header is fed with low-pressure gas to prevent the adverse effects of hot gas and high head pressure on the compressors.

SUMMARY OF INVENTION

It is a feature of the present invention to provide a high-speed defrost refrigeration system that operates a defrost of evaporators at low pressure.

It is a further feature of the present invention to provide a high-speed defrost refrigeration system having a compressor dedicated to defrost cycles.

It is a still further feature of the present invention to provide a high-speed defrost refrigeration system having a low-pressure defrost loop.

It is a still further feature of the present invention to provide a method for defrosting at high-speed refrigeration systems with low-pressure in the evaporators.

It is a still further feature of the present invention to provide a method for operating a high-speed defrost refrigeration system having a compressor dedicated to defrost cycles.

According to the above features, from a broad aspect, the present invention provides a defrost refrigeration system of the type having a main refrigeration circuit, wherein a refrigerant goes through at least a compressing stage, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the compressing stage to the evaporator stage and adapted to receive a portion of the refrigerant in the high-pressure gas state. A first pressure reducing device on the first line reduces a pressure of the portion of the refrigerant in the high-pressure gas state to a second low-pressure gas state. Valves stop a flow of the refrigerant in the first low-pressure liquid state to at least one evaporator of the evaporator stage and direct a flow of the refrigerant in the second low-pressure gas state to release heat to defrost the at least one evaporator and thereby change phase at least partially to a second low-pressure liquid state. A second line directs the refrigerant having released heat to at least one of the compressing stage and the condensing stage.

According to a further broad feature of the present invention, there is provided a defrost refrigeration system of the type having a main refrigeration circuit, wherein a refrigerant goes through at least a first compressor in a compressing stage, wherein the refrigerant is compressed to a high-pressure gas state to then reach a condensing stage wherein the refrigerant in the high-pressure gas is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the compressing stage to the evaporator stage and is adapted to receive a portion of the refrigerant in the high-pressure gas state. Valves stop a flow of the refrigerant in the first low-pressure liquid state to at least one evaporator of the evaporator stage and direct a flow of the portion of the refrigerant in the high-pressure gas state to release heat to defrost the at least one evaporator and thereby change phase to a second low-pressure liquid state. A dedicated compressor is adapted to receive an evaporated gas portion of the refrigerant in the second low-pressure liquid state. The dedicated compressor is connected to the condensing stage for directing a discharge thereof to the condensing stage.

According to a still further broad feature of the present invention, there is provided a method for defrosting evaporators of a refrigeration system of the type having a main refrigeration circuit, wherein a refrigerant goes through at least a compressing stage, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The method comprises the steps of i) stopping a flow of the refrigerant in the first low-pressure liquid state to at least one evaporator of the evaporator stage; ii) reducing a pressure of a portion of the refrigerant in the high-pressure gas state to a second low-pressure gas state; and iii) directing the portion of the refrigerant in the second low-pressure gas state to the at least one evaporator to release heat to defrost the at least one evaporator and thereby changing phase at least partially to a second low-pressure liquid state.

According to a still further broad feature of the present invention, there is provided a method for defrosting evaporators of a refrigeration system of the type having a main refrigeration circuit, wherein a refrigerant goes through at least a compressing stage having at least a first compressor, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The method comprises the steps of i) stopping a flow of the refrigerant in the first low-pressure liquid state to at least one evaporator; ii) directing a portion of the refrigerant in the high-pressure gas state to the at least one evaporator to release heat to defrost the at least one evaporator and thereby changing phase at least partially to a second low-pressure liquid state; and iii) directing an evaporated gas portion of the refrigerant in the second low-pressure gas state to a dedicated compressor, the dedicated compressor being connected to the condensing stage for directing a discharge thereof to the condensing stage.

According to a still further broad feature of the present invention, there is provided a defrost refrigeration system of the type having a main refrigeration circuit, wherein a refrigerant goes through at least a compressing stage, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the compressing stage to the evaporator stage and adapted to receive a portion of the refrigerant in the high-pressure gas state. Valves are provided for stopping a flow of the refrigerant in the first low-pressure liquid state to at least one evaporator of the evaporator stage and directing a flow of the refrigerant in the high-pressure gas state to release heat to defrost the at least one evaporator and thereby changing phase at least partially to a second low-pressure liquid state. A second line is provided for directing the refrigerant having released heat to the compressing stage, and pressure control means in the second line for controlling a pressure of the refrigerant reaching the compressing stage.

According to a still further broad feature of the present invention, there is provided a defrost refrigeration system of the type having a main refrigeration circuit, wherein a refrigerant goes through at least a compressing stage, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the compressing stage to the evaporator stage and adapted to receive a portion of the refrigerant in the high-pressure gas state. Valves are provided for stopping a flow of the refrigerant in the first low-pressure liquid state to at least two evaporators of the evaporator stage and directing a flow of the refrigerant in the high-pressure gas state to release heat to defrost the at least two evaporators and thereby changing phase at least partially to a second low-pressure liquid state. A second line is provided for directing the refrigerant having released heat in the at least two evaporators to the compressing stage. Temperature monitor means are adapted to monitor an average temperature of the refrigerant in the second line and to reverse an action of the valves when the temperature reaches a predetermined value to re-establish the flow of the refrigerant in the first low-pressure liquid state to the at least two evaporators of the evaporator stage.

According to a still further broad feature of the present invention, there is provided a defrost refrigeration system of the type having a main refrigeration circuit, wherein a refrigerant goes through at least a compressing stage, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded by an expansion valve to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the compressing stage to the expansion stage and adapted to receive a portion of the refrigerant in the high-pressure gas state. Valves are provided for stopping a flow of the refrigerant in the first low-pressure liquid state to at least one evaporator of the evaporator stage and directing a flow of the refrigerant in the high-pressure gas state around the expansion valve to the at least one evaporator of the evaporator stage to release heat to defrost the at least one evaporator and thereby changing phase at least partially to a second low-pressure liquid state, to then be directed to the compressing stage.

According to a still further broad feature of the present invention, there is provided a defrost refrigeration system of the type having a main refrigeration circuit, wherein a refrigerant goes through at least a compressing stage having at least a first and a second compressor, wherein the refrigerant is compressed to a high-pressure gas state to then reach a condensing stage, wherein the refrigerant in the high-pressure gas state is condensed at least partially to a high-pressure liquid state to then reach an expansion stage, wherein the refrigerant in the high-pressure liquid state is expanded to a first low-pressure liquid state to then reach an evaporator stage, wherein the refrigerant in the first low-pressure liquid state is evaporated at least partially to a first low-pressure gas state by absorbing heat, to then return to the compressing stage. The defrost refrigeration system comprises a first line extending from the first compressor to the evaporator stage and adapted to receive at least a portion of discharged low-pressure refrigerant from the first compressor. Valves are provided for stopping a flow of the refrigerant in the first low-pressure liquid state to at least one evaporator of the evaporator stage and directing a flow of the discharged low-pressure refrigerant to release heat to defrost the at least one evaporator and thereby changing phase at least partially to a second low-pressure liquid state. A second line is provided for directing the refrigerant having released heat to the evaporator stage.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
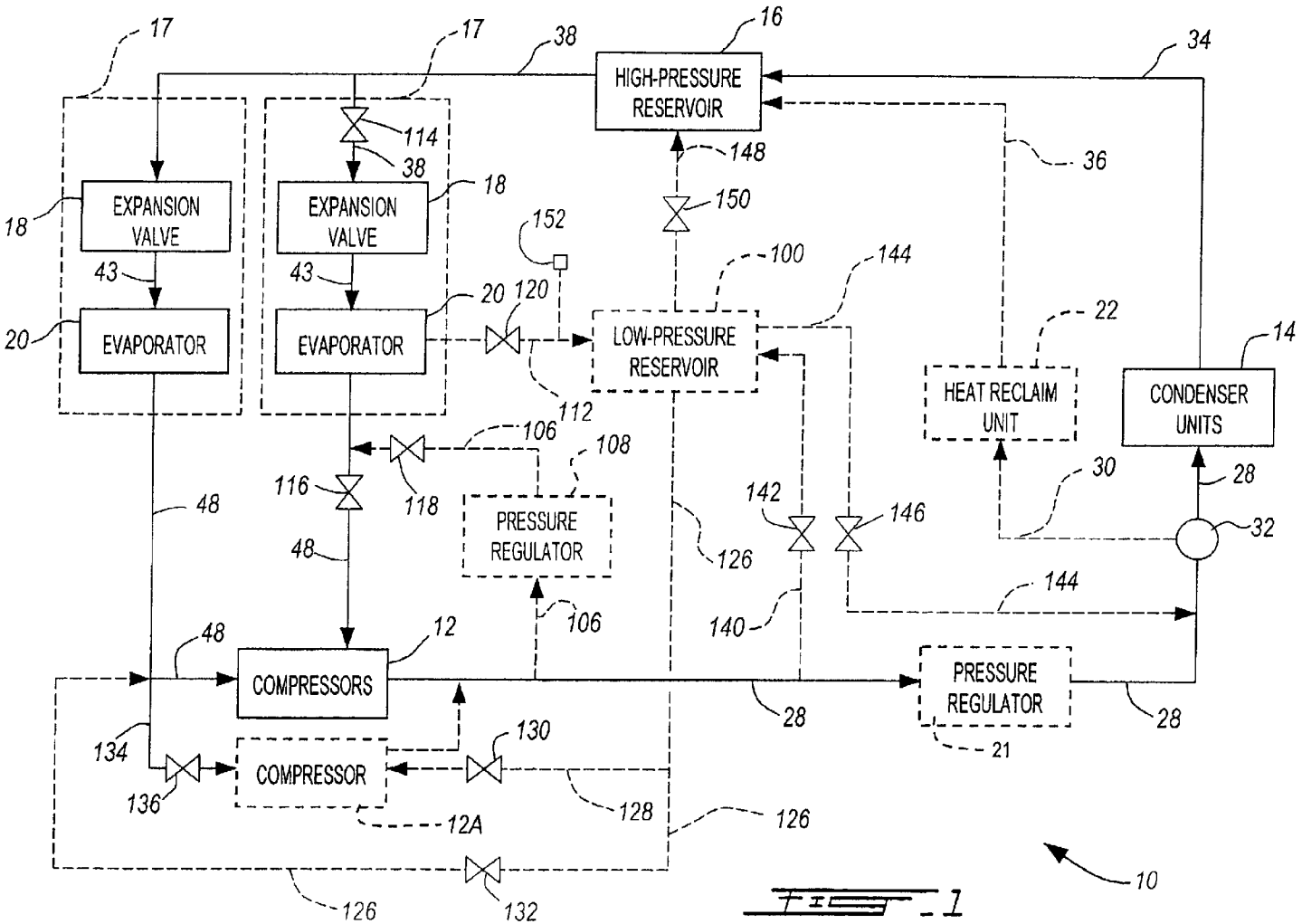
FIG. 1 is a block diagram showing a simplified refrigeration system constructed in accordance with the present invention.

Referring to the drawings, and more particularly to FIG. 1, a refrigeration system in accordance with the present invention is generally shown at 10. The refrigeration system 10 comprises the components found on typical refrigeration systems, such as compressors 12 (one of which is 12A, for reasons to be described hereinafter), a high-pressure reservoir 16, expansion valves 18, and evaporators 20. The refrigeration system 10 is shown having a heat reclaim unit 22, which is optional. In FIG. 1, the refrigeration system 10 is shown having only two sets of evaporator 20/expansion valve 18 for the simplicity of the illustration. It is obvious that numerous other sets of evaporator 20/expansion valve 18 may be added to the refrigeration system 10.

The compressors 12 are connected to the condenser units 14 by lines 28. A pressure regulator 21 is in the line 28 but is not in operation during normal refrigeration cycles, and is thus normally open to enable refrigerant flow therethrough. High-pressure gas refrigerant is discharged from the compressors 12 and flows to the condenser units 14 through the line 28. A line 30 diverges from the line 28 by way of three-way valve 32. The line 30 extends between the three-way valve 32 and the heat reclaim unit 22. A line 34 connects the condenser units 14 to the high-pressure reservoir 16, and a line 36 links the heat reclaim unit 22 to the high-pressure reservoir 16. The condenser units 14 are typically rooftop condensers that are used to release energy of the high-pressure gas refrigerant discharged by the compressors 12 by a change to the liquid phase. Accordingly, refrigerant accumulates in the high-pressure reservoir 16 in a liquid state.

Evaporator units 17 are connected between the high-pressure reservoir 16 and the compressors 12. Each of the evaporator units 17 has an evaporator 20 and an expansion valve 18. The expansion valves 18 are connected to the high-pressure reservoir 16 by line 38. As known in the art, the expansion valves 18 create a pressure differential so as to control the pressure of liquid refrigerant sent to the evaporators 20. The outlet of the evaporators 20 are connected to the compressors 12 by lines 48. The compressors 12 are supplied with low-pressure gas refrigerant via supply lines 48. The expansion valves 18 control the pressure of the liquid refrigerant that is sent to the evaporators 20, such that the liquid refrigerant changes phases in the evaporators 20 by a fluid, such as air, blown across the evaporators 20 to reach refrigerated display counters (e.g., refrigerators, freezers or the like) at low refrigerating temperatures.

Refrigerant in the refrigeration system 10 is in a high-pressure gas state when discharged from the compressors 12. For instance, a typical head pressure of the compressors is 200 Psi. The compressor head pressure obviously changes as a function of the outdoor temperature to which will be subject the refrigerant in the condensing stage. The high-pressure gas refrigerant is conveyed to the condenser units 14 and, if applicable, to the heat reclaim unit 22 via the line 28 and the line 30, respectively.

In the condenser units 14 and the heat reclaim unit 22, the refrigerant releases heat so as to go from the gas state to a liquid state, with the pressure remaining generally the same. Accordingly, the high-pressure reservoir 16 accumulates high-pressure liquid refrigerant that flows thereto by the lines 34 and 36, as previously described.

The compressors 12 exert a suction on the evaporators 20 through the supply lines 48. The expansion valves 18 control the pressure in the evaporators 20 as a function of the suction by the compressors 12. Accordingly, high-pressure liquid refrigerant accumulates in the line 38 to thereafter exit through the expansion valves 18 to reach the evaporators 20 via the lines 43 in a low-pressure liquid state. The typical pressure at an outlet of the expansion valve 18 is 35 Psi. During a refrigeration cycle, the refrigerant absorbs heat in the evaporators 20, so as to change state to become a low-pressure gas refrigerant. Finally, the low-pressure gas refrigerant flows through the line 48 so as to be compressed once more by the compressors 12 to complete the refrigeration cycle.

As frost and ice build-up are frequent on the evaporators, the evaporators 20 are provided with a defrost system for melting the frost and ice build-up. Only one of the evaporator units 17 is shown having defrost equipment, for simplicity of the drawings. It is obvious that all evaporator units 17 can be provided with defrost equipment. One of the evaporators 20 is supplied with refrigerant discharged from the compressors 12 by a line 106 having a pressure regulator 108 therein. The pressure regulator 108 creates a pressure differential in the line 106, such that the high-pressure gas refrigerant, typically around 200 Psi, is reduced to a low-pressure gas refrigerant thereafter, for instance at about 110 Psi. The pressure regulator 108 may include a modulating valve in line 106. In the event that the pressure in the evaporator 20 is lower than that of the refrigerant conveyed thereto by the line 106 in a defrost cycle, the modulating valve portion of the pressure regulator 108 will preclude the formation of water hammer by gradually increasing the pressure in the evaporator 20. This feature of the pressure regulator 108 will allow the refrigeration system 10 to feed the evaporators 20 with high-pressure refrigerant, although it is preferred to defrost the evaporators 20 with low-pressure refrigerant. On the other hand, the modulating action can be effected by the valves 118.

Valves are provided in the evaporator units 17 so as to control the flow of refrigerant in the evaporators 20. A valve 114 is provided in the line 38. The valve 114 is normally open, but is closed during defrosting of its evaporator unit 17. A valve 116 is positioned on the line 48 and is normally open. The line 106 merges with the line 48 between the valve 116 and the evaporator 20. The line 106 has a valve 118 therein. A line 112, connecting a low-pressure reservoir 100 to the evaporator 20, has a valve 120 therein. The valves 118 and 120 are closed during a normal refrigeration cycle of their respective evaporators 20.

In a normal refrigeration cycle, refrigerant flows in the line 38 through the valve 114, to reach the expansion valves 18. A pressure drop in refrigerant is caused at the expansion valve 18. The resulting low-pressure liquid refrigerant reaches the evaporators 20, wherein it will absorb heat to change state to gas. Thereafter, refrigerant flows through the low-pressure gas refrigerant line 48 and the valve 116 therein to the compressors 12.

During a defrost cycle of an evaporator 20, the valves 118 and 120 are open, whereas the valves 114 and 116 are closed. Accordingly, the expansion valve 18 and the evaporator 20 will not be supplied with low-pressure liquid refrigerant from the line 38, as it is closed by valve 114. During the defrost cycle, low-pressure gas refrigerant accumulated in the line 106, downstream of the pressure regulator 108, is conveyed back into the evaporator 20 through the portion of line 48 between the valve 116 and the evaporator 20. As the valve 116 is closed and the valve 118 is open. The closing of the valve 116 ensures that refrigerant will not flow from the line 106 to the compressors 12. As the low-pressure gas refrigerant flows through the evaporator 20, it releases heat to defrost and melt ice build-up on the evaporator 20. This causes a change of phase to the low-pressure gas refrigerant, which changes to low-pressure liquid refrigerant. Thereafter, the low-pressure liquid refrigerant flows through the line 112 and the valve 120 to reach the low-pressure reservoir 100. The low-pressure reservoir 100 accumulates liquid refrigerant at low pressure.

The low-pressure reservoir 100 is connected to the compressors 12 by a line 126. The line 126 is connected to a top portion of the reservoir 100 such that evaporated refrigerant exits therefrom. As the low-pressure reservoir 100 accumulates low-pressure liquid refrigerant, evaporation will normally occur such that a portion of the reservoir above the level of liquid refrigerant will comprise low-pressure gas refrigerant. The pressure in the low-pressure reservoir 100 is typically as low as 10 Psi.

However, with the present invention a compressor is dedicated for discharging the low-pressure reservoir 100, whereas the other compressors receive refrigerant exiting from the evaporators 20. Reasons for the use of a dedicated compressor will be described hereinafter. Accordingly, as shown in FIG. 1, the compressor 12A will be dedicated to discharging the low-pressure reservoir 100. A line 128 diverges from the line 126 to reach the compressor 12A. A valve 130 is in the line 128, whereas a valve 132 is in the line 126. During operation of the dedicated compressor 12A, the valve 132 is closed, whereas the valve 130 is open.

A bypass line 134 and a check valve 136 therein are connected from the line 48 to the compressor 12A. The pressure in the lines 126 and 128 is generally lower than in the line 48. The check valve 136 therefore enables a flow of refrigerant therethrough such that the inlet pressure at the compressors 12 and the dedicated compressor 12A is generally the same.

In order to flush the liquid refrigerant in the low-pressure reservoir 100 such that the latter does not overflow, a flushing arrangement is provided for the periodic flushing of the low-pressure reservoir 100. The flushing arrangement has a line 140 having a valve 142 therein diverging from the line 28 and connecting to the low-pressure reservoir 100. The line 140 diverges from the line 28 upstream of the pressure regulator 21, such that high-pressure gas refrigerant can be directed from the compressors 12 directly to the low-pressure reservoir 100.

A line 144 having a valve 146 extends from the low-pressure reservoir 100 to the line 28 downstream of the pressure regulator 21, and upstream of the three-way valve 32. A line 148 having a valve 150 goes from the low-pressure reservoir 100 to the high-pressure reservoir 16. A periodic flush of the low-pressure reservoir 100 is initiated by creating a pressure differential (e.g., 5 psi) in the line 28.

The valve 142 is opened while the valves 130 and 132 are simultaneously closed, if they were open. Accordingly, high-pressure gas refrigerant can be directed to the low-pressure reservoir 100, but will be prevented from reaching the compressors 12 and 12A. One of the valves 146 and 150 is opened, while the other remains closed. If the valve 146 is opened, a mixture of gas and liquid refrigerant will flow through the line 144 and to the line 28 downstream of the pressure regulator 21. It is pointed out that the pressure differential caused by the pressure regulator 21 will create this flow. If the valve 150 is opened, the gas/liquid refrigerant will flow through the line 148 to reach the high-pressure reservoir 16, in this case having a lower pressure than the low-pressure reservoir 100, by the insertion of compressor discharge in the low-pressure reservoir 100 via line 140, and by the pressure drop caused by the pressure regulator 21.

When the defrost cycle has been completed, the valves are reversed so as to return the defrosted evaporator 20 to the refrigeration cycle. More specifically, the valves 114 and 116 are opened, and the valves 118 and 120 are closed. It is preferred that the valve 116 be of the modulating type (e.g., Mueller modulating valve, www.muellerindustries.com), or a pulse valve. Accordingly, a pressure differential in the line 48 between upstream and downstream portions with respect to the valve 116 will not cause water hammer when the valve 116 is open. The pressure will gradually be decreased by the modulation of the valve 116. Furthermore, the refrigerant reaching the compressors 12 via the line 48 will remain at advantageously low pressures. Although in the preferred embodiment of the present invention the refrigerant defrosting the evaporators 20 will be at generally low pressure because of the pressure regulator 108, the refrigeration system 10 of the present invention may also provide high-pressure refrigerant to accelerate the defrosting of the evaporators 20, whereby the modulation of the valve 116 is preferred when a defrosted evaporator 20 is returned to the refrigeration cycle. It is obvious that equivalents of the valve 116 can be used, and such equivalents will be discussed hereinafter.

In the warmer periods, such as summer, the flushing is directed to the condenser units 14 via the line 144, such that the liquid content of the flush cools the condenser units 14. In the cooler periods, the flush is directed to the high-pressure reservoir 16. When the flush is completed, for instance, when the liquid level in the low-pressure reservoir 100 reaches a predetermined low level, the flush is stopped by the closing of the valves 142 and 146 or 150 and the deactivation of the pressure regulator 21. The valves 130 or 132 can also be opened if defrosting of one of the evaporators 20 is required.

It is obvious that the control of valve operation is preferably fully automated. As mentioned above, the flushing of the low-pressure reservoir 100 can be stopped by the low-pressure reservoir 100 reaching a predetermined low level. Similarly, the flush of the low-pressure reservoir 100 can be initiated by the refrigerant level reaching a predetermined high level in the low-pressure reservoir 100. Similarly, the valve operation for controlling the defrost of evaporators 20, namely the control of valves 114, 116, 118, 120, 130 and 132, is fully automated. For the flushing of the low-pressure reservoir 100, and in the defrost cycles, an automation system may also be programmed to do periodic flushing or defrost cycles, respectively. It also has been thought to provide a pump (not shown) to pump the liquid refrigerant in the low-pressure reservoir 100 to the line 28 or to the high-pressure reservoir 16.

It is an advantageous feature to have a dedicated compressor 12A. It is known that compressors are not adapted to receive liquids therein. However, as the defrost cycles produce a change of phase of gas refrigerant to liquid refrigerant, there is a risk that liquid refrigerant reaches the compressors 12. It is thus important that the low-pressure reservoir 100 does not overflow, whereby the flushing can be actuated, as described above, upon the low-pressure reservoir's 100 reaching a predetermined high level of refrigerant. An alarm system (not shown) can also be provided in order to shut-off the compressors in the event of a low-pressure reservoir overflow. The alarm can be used to shut-off the compressors such that liquid refrigerant cannot affect the compressors. However, this involves a risk of fouling the foodstuff in the refrigeration display counters. The use of a dedicated compressor 12A, isolated from the other compressors 12, can prevent the shutting down of all compressors or the liquid from reaching the compressors. As described above, the valve 132 is shut during the use of the dedicated compressor 12A such that the low-pressure reservoir 100 is isolated from the compressors 12. On the other hand, the alarm (not shown) can be connected to the valve 130 in order to shut-off the valve 130 when an overflow of the low-pressure reservoir 100 is detected. The compressor 12A will then be supplied with gas refrigerant from the line 48 through the check valve 136.

The defrosting of one of the evaporators 20 can be stopped according to a time delay. More precisely, a defrost cycle of an evaporator 20 can be initiated periodically and have its duration predetermined. For instance, a typical defrost portion of a defrost cycle can last 8 minutes for low pressures of refrigerant fed to the evaporators 20 and can be even shorter for higher pressures. Thereafter, a period is required to have the defrosted evaporator 20 returned to its normal refrigeration operating temperature, and such a period is typically up to 7 minutes in duration. It is also possible to have a sensor 152 positioned downstream of the evaporator 20 in a defrost cycle, that will control the duration of the defrost cycle of a respective evaporator 20 by monitoring the temperature of the refrigerant having defrosted the respective evaporator 20. A predetermined low refrigerant temperature detected by the sensor 152 could trigger an actuation of the valves 114, 116, 118 and 120, to switch the respective evaporator 20 to a refrigeration cycle 20.

It is known to provide the sensor 152. However, these sensors have been previously provided after each evaporator 20. Accordingly, this proves to be a costly solution. Furthermore, in systems wherein defrost is effected for a few evaporators simultaneously, these evaporators are often synchronized to return back to refrigeration cycles only once all temperature sensors reach their predetermined low limit. This causes unnecessarily lengthy defrost cycles. The sensor 152 of the present invention is thus preferably positioned so as to measure an average temperature of the defrost refrigerant of all evaporators defrosted simultaneously. In consequence thereof, fewer sensors 52 are necessary and the operation of defrost cycles is more efficient.

It is obvious that the various components enabling the defrost cycle can be regrouped in a pack so as to be provided on site as a defrost system ready to operate. This can simplify the installation of the defrost system to an existing refrigeration system, as the major step in the installation would be to connect the various lines to the defrost system.

Figure 2:
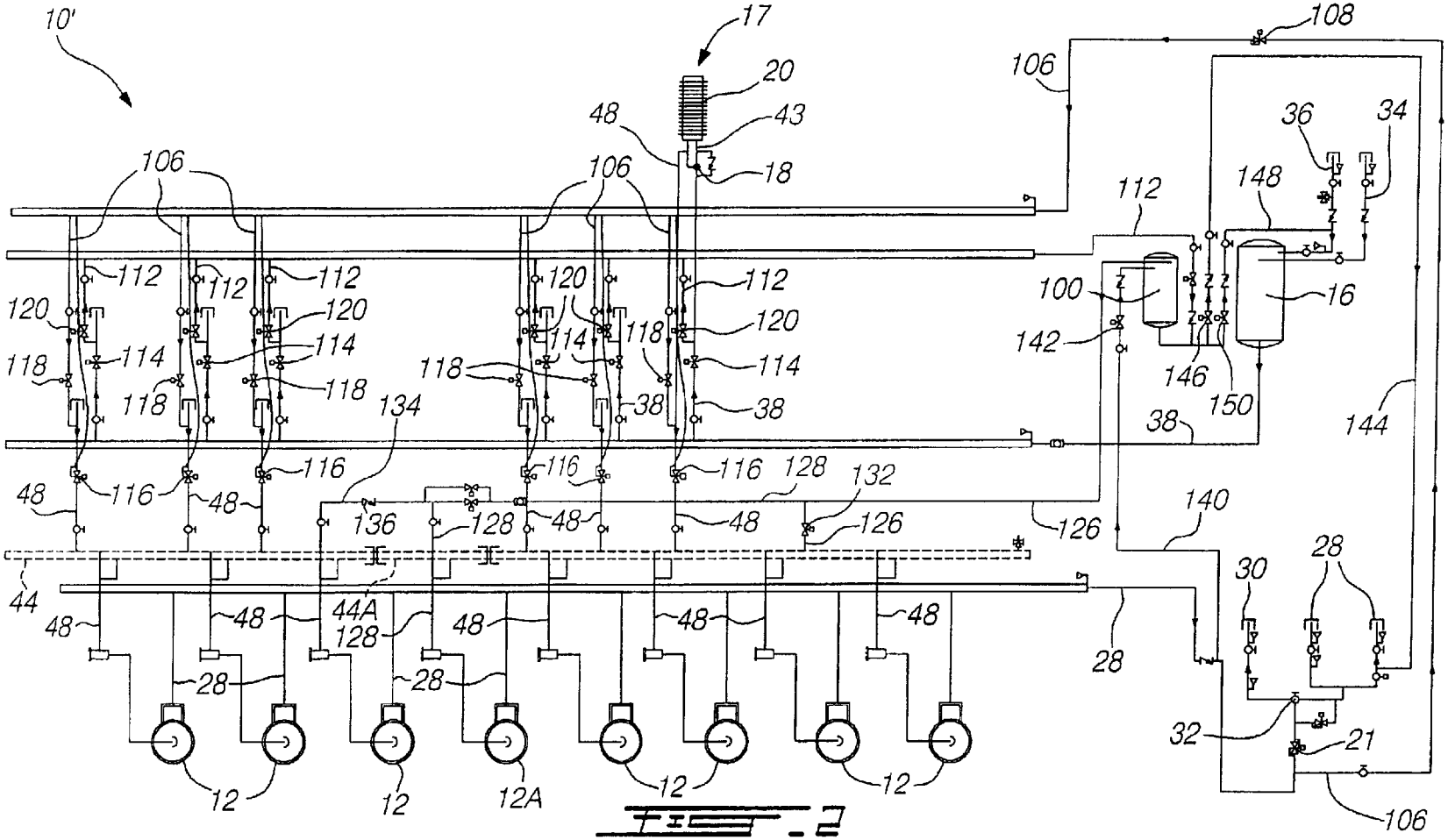
FIG. 2 is a schematic view showing a refrigeration system constructed in accordance with the present invention.
Figure 3:
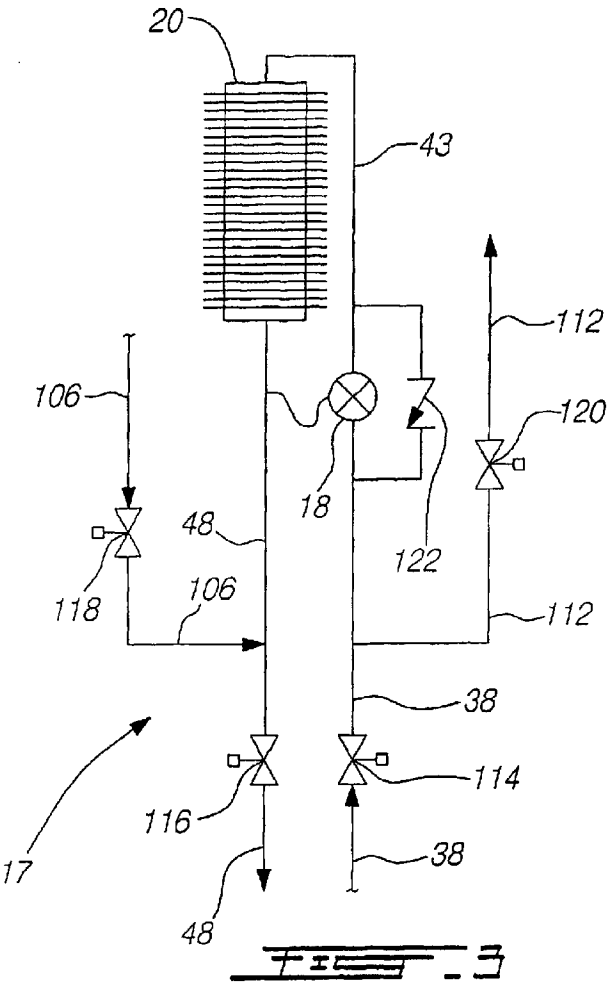
FIG. 3 is an enlarged schematic view of an evaporator unit of the refrigeration system.

Now that the refrigeration system 10 has been described with reference to a simplified schematic figure, a refrigeration system 10' is shown in FIGS. 2 and 3 in further detail. It is pointed out that like numerals will designate like elements. Furthermore, the refrigeration system 10' illustrated in FIGS. 2 and 3 comprises additional elements to the refrigeration system 10, and these additional elements are common to refrigeration systems but have been removed from FIG. 1 for clarity purposes.

As seen in FIG. 2, the compressors 12 and 12A are connected to the line 28, which has a discharge header 24 to collect the discharge of all compressors 12 and 12A. Although not shown, it is common to have an oil separator that will remove oil contents from the high-pressure gas refrigerant in the line 28. The three-way valve 32 is preferably a motorized modulating valve that will prevent water hammer when stopping a supply of refrigerant to the heat reclaim unit 22.

The refrigeration system 10' has a high-pressure liquid refrigerant header 40 and a suction header 44. The high-pressure liquid refrigerant header 40 is in the line 38 and thus connected to the high-pressure reservoir 16 to supply refrigerant to the evaporators 20. The suction header 44 is connected to inlets of the compressors 12 by the lines 48. Refrigerant accumulates in the suction header 44 in a low-pressure gas state, and is conveyed through the lines 48 to the compressors 12 by the pressure drop at the inlets of the compressors 12.

Numerous evaporator units 17 extend between the high-pressure reservoir 16 and the suction header 44, but only one is fully shown in FIG. 2 for clarify purposes. Each of the evaporator units 17 has an evaporator 20 and an expansion valve 18. The expansion valves 18 are connected to the high-pressure liquid refrigerant header 40 by the lines 38, and to the evaporators 20 by the lines 43. As mentioned above, the expansion valves 18 create a pressure differential so as to control the pressure of liquid refrigerant sent to the evaporators 20. The expansion valves 18 control the pressure of the liquid refrigerant that is sent to the evaporators 20 as a function of a fluid that is blown on the evaporators 20 (e.g., air), such that the liquid refrigerant changes phases in the evaporators 20 by the fluid, blown across the evaporators 20 to reach refrigerated display counters (e.g., refrigerators, freezers or the like) at low refrigerating temperatures.

The compressors 12 exert a suction on the evaporators 20 through the suction header 44 and the lines 48. The expansion valves 18 control the pressure in the evaporators 20 as a function of the suction by the compressors 12. Accordingly, high-pressure liquid refrigerant accumulates in the line 38 and the high-pressure liquid refrigerant header 40 to thereafter exit through the expansion valves 18 to reach the evaporators 20 in a low-pressure liquid state.

In the refrigeration system 10', the defrost system has a low-pressure gas header 102 and a low-pressure liquid header 104. The low-pressure gas header 102 is supplied with refrigerant discharged from the compressors 12 by a defrost line 106. As mentioned previously, the pressure regulator 108 creates a pressure differential, such that the high-pressure gas refrigerant is reduced to a low-pressure gas refrigerant thereafter. The low-pressure gas header 102 and the low-pressure liquid header 104 are connected by the evaporator units 17. As seen in FIG. 3, the valve 114 is provided on the line 38, with the line 112 connected to the line 38 between the expansion valve 18 and the valve 114. The valve 114 is normally open, but is closed during defrosting of its evaporator unit 17. The valve 116 is positioned on the line 48 and is normally open. The line 106 merges with the line 48 between the valve 116 and the evaporator 20. The line 106 has the valve 118 therein, and the defrost outlet line 112 has the valve 120 therein. The valves 118 and 120 are closed during a normal refrigeration cycle of their respective evaporators 20. A check valve 122 is provided parallel to the expansion valve 18. It is pointed out that the check valve 122 is not shown in FIG. 1, yet the refrigeration system 10 of FIG. 1 and the refrigeration system 10' of FIG. 2 operate in an equivalent fashion. The check valve 122 enables the use of the line 43 and a portion of the line 38 for defrost cycles, and this reduces the number of pipes going to the evaporators 20. Furthermore, the check valves 122 will facilitate the adaptation of a defrost system to an existing refrigeration system.

Figure 4:
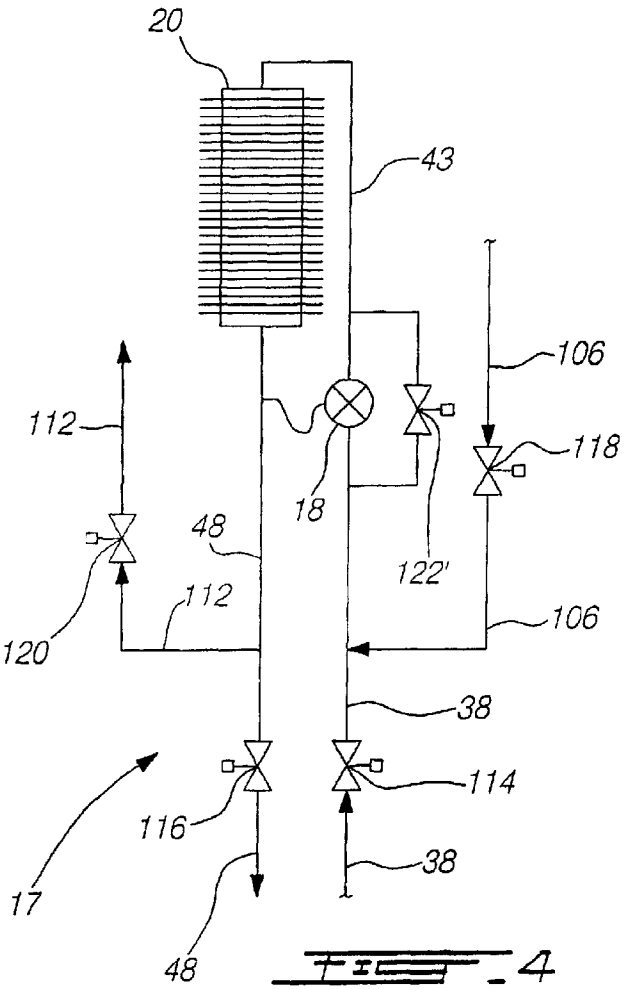
FIG. 4 is an enlarged schematic view of an evaporator unit in accordance with another embodiment of the present invention.

Although, as illustrated in FIG. 3, the line 106 is preferably connected to the line 48 to feed the evaporator 20 with refrigerant, whereas the line 112 is connected to the line 38 to provide an outlet for the refrigerant after having gone through the evaporator 20, it is pointed out that the lines 106 and 112 can be appropriately connected. As shown in FIG. 4, the line 106 is connected to the line 38, whereas the line 112 is connected to the line 48. In doing so, the check valve 122 of FIG. 3 is replaced by a solenoid valve 122' that will allow refrigerant to bypass the expansion valve 18 to reach the evaporator 20.

Therefore, as seen in FIGS. 2 and 3, in a normal refrigeration cycle, refrigerant flows in the line 38 through the valve 114. The check valve 122 blocks flow therethrough in that direction of flow of refrigerant, such that refrigerant has to go through the expansion valve 18 to reach the evaporator 20 via the line 43. Thereafter, refrigerant flows through the line 48, including the valve 116 and the suction header 44, to reach the compressors 12.

During a defrost cycle of one of the evaporators 20, the valves 118 and 120 are open, whereas the valves 114 and 116 are closed. Accordingly, the expansion valve 18 and the evaporator 20 will not be supplied with low-pressure liquid refrigerant from the line portion 38, as it is closed by valve 114. During the defrost cycle, low-pressure gas refrigerant is conveyed from the line 106 to the evaporator 20 through a portion of the line 48. The valve 116 is closed and the valve 118 is open. As the valve 116 is closed, refrigerant will not flow from the line 106 to the suction header 44. As the low-pressure gas refrigerant flows through the evaporator 20, it releases heat to defrost and melt ice build-on the evaporator 20. This causes a change of phase to the low-pressure gas refrigerant, which changes to low-pressure liquid refrigerant. The check valve 122 will allow refrigerant to accumulate upstream thereof, such that the refrigerant in the evaporator 20 has time to release heat to melt the ice build-up on the evaporator 20. The check valve 122 will open above a given pressure, such that low-pressure liquid refrigerant can flow through the line 38 to the line 112 and the valve 120 to reach the low-pressure liquid header 104 and the low-pressure reservoir 100.

The low-pressure reservoir 100 is connected to the suction header 144 by the line 126. The line 126 is connected to a top portion of the reservoir 100 such that evaporated refrigerant exits therefrom.

The compressor 12A has its own portion 44A of the header 44. The portion 44A is separated from the suction header 44. The line 128 extends from the line 126 to the suction header portion 44A. A valve 130 is in the line 128, whereas the valve 132 is in the reservoir discharge line 126. During operation of the dedicated compressor 12A, the valve 132 is closed, whereas the valve 130 is open. The line 134 and the check valve 136 therein merge with the line 128 such that the dedicated compressor 12A can be supplied with refrigerant from the suction header 44 to operate at a same pressure as the compressors 12.

A line 160 provides a valve 162 parallel to the valve 130. The line 160 has a small diameter, and is used to lower the pressure of the gas refrigerant coming from the low-pressure reservoir 100 after a flush of the low-pressure reservoir 100 has been performed.

A plurality of check valves 164 and manual valves 166 are provided through the refrigeration system 10' to ensure the proper flow direction and allow maintenance of various parts of the refrigeration system 10'.

The refrigeration system 10 of the present invention is advantageous, as it provides a defrost system that can readily be adapted to existing refrigeration systems. The valve configuration in the evaporator units 17, as shown in FIG. 3, provides for the use of existing pipe of typical refrigeration systems for defrost cycles. Also, the evaporators 20 only receive low-pressure refrigerants therein, as opposed to known defrost systems, and this ensures that most types of evaporators are compatible with the present invention. For instance, aluminum coils of an evaporator may not be specified for high refrigerant pressures that are typical to known defrost systems. Finally, the dedicated compressor 12A is a safety feature that will prevent costly failures and breakdown of all compressors 12, and thus reduces the risks of fouling foodstuff.

Figure 5:
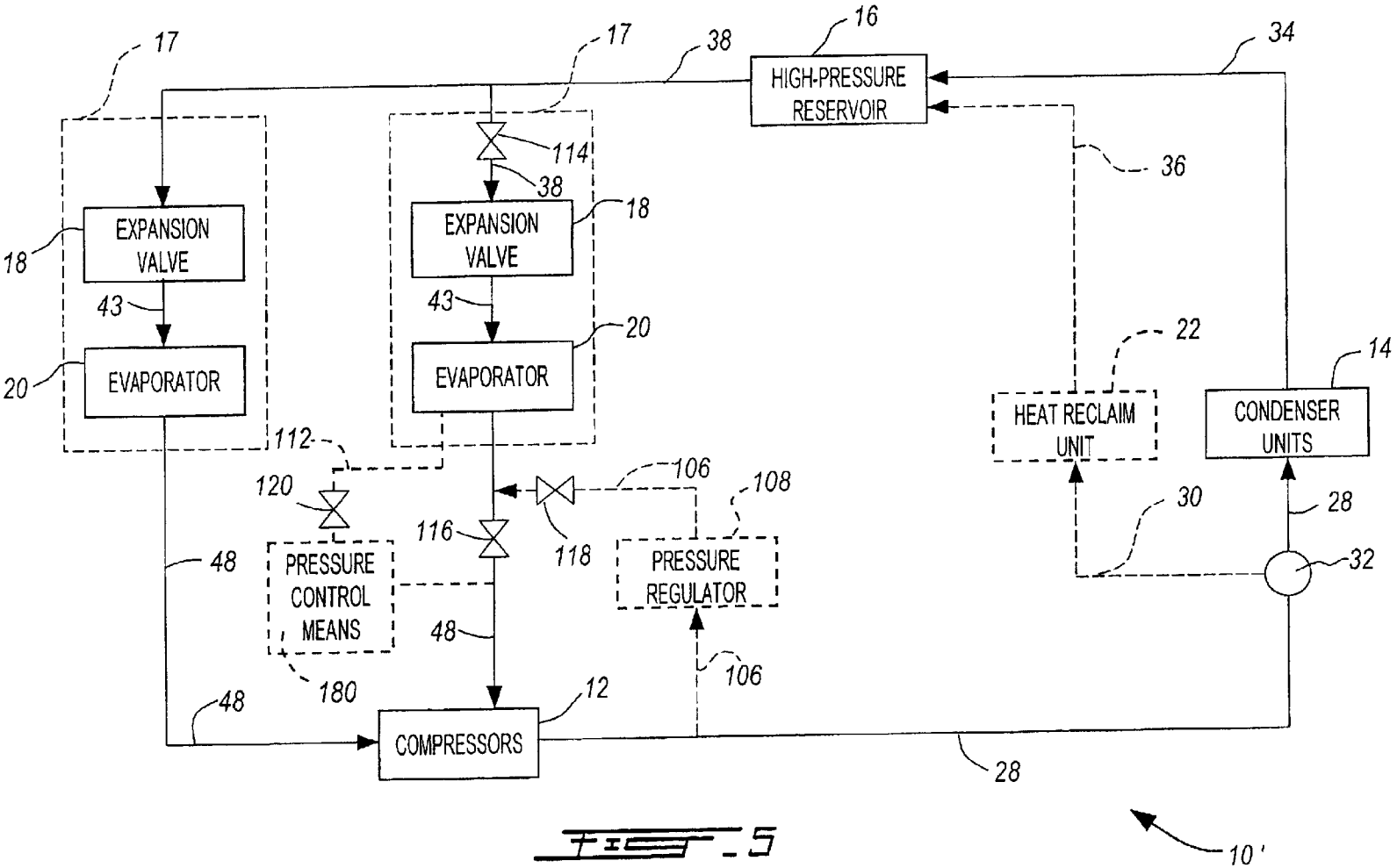
FIG. 5 is a block diagram showing a simplified refrigeration system constructed in accordance with another.

In FIG. 5, there is shown an alternative to the low-pressure reservoir 100. In the refrigeration system 10' of FIG. 5, the line 112 is connected to the line 48, downstream of the valve 116, for directing refrigerant directly to the compressors after having defrosted the evaporator 20. The refrigeration system 10' is similar to the refrigeration system 10 of FIG. 1, whereby like elements will bear like numerals.

Pressure control means 180 are provided in the line 112, downstream of the valve 120. The pressure control means 180 will ensure that defrosting refrigerant reaching the compressors 12 is at a pressure generally similar to that of the refrigerant flowing to the compressors 12 after a refrigeration cycle. The pressure control means 180 may consist of any one of outlet regulating valves, modulating valves, pulse valves and a liquid accumulator, and may also consist in a circuit having heat exchangers (e.g., roof-top radiators) and expansion valves, that will reduce the refrigerant pressure and change the phase thereof. In the case where the pressure control means 180 are outlet regulating valves, these may be positioned directly after the evaporators 20, or just before inlets of compressors 12, to prevent liquid refrigerant from reaching the compressors 12 and to control the pressure of refrigerant supplied thereto. A liquid accumulator would preferably be positioned between suction headers (not shown) so as to ensure that no liquid refrigerant is fed to the compressors 12. Considering that the refrigerant having defrosted an evaporator 20 will be generally liquid, the liquid accumulator prevents excessive liquid refrigerant from blocking the lines. The pressure control means 180 will enable the compressors 12 to operate at low pressures, i.e., independently from the pressure of refrigerant at the outlet of the defrost evaporators. Therefore, more evaporators can be defrosted at a same time as the compressor inlet pressure is generally independent from the number of evaporators in defrost, whereby such simultaneous defrosting will not substantially increase the energy costs of the compressors 12.

As mentioned previously, typical defrost periods with the refrigeration system 10 of the present invention are of 8 minutes for the evaporator 20 to reach the highest temperature, and 7 minutes for returning back to an operating temperature. Therefore, a total of 15 minutes is achievable from start to finish for a defrost period with the refrigeration system 10 of the present invention.

Figure 6:
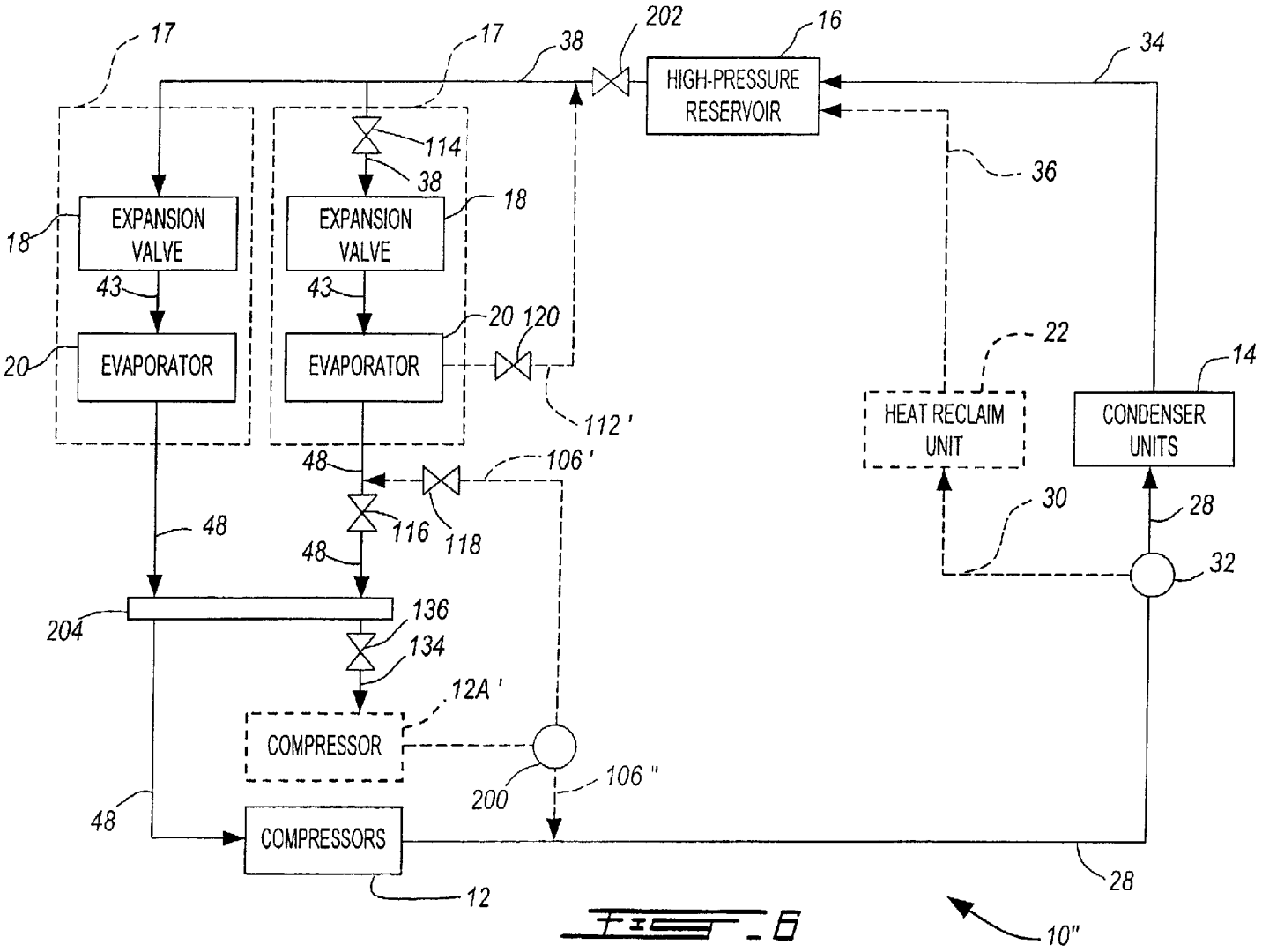
FIG. 6 is a block diagram showing a simplified refrigeration system constructed in accordance with still another embodiment of the present invention.
Figure 7:
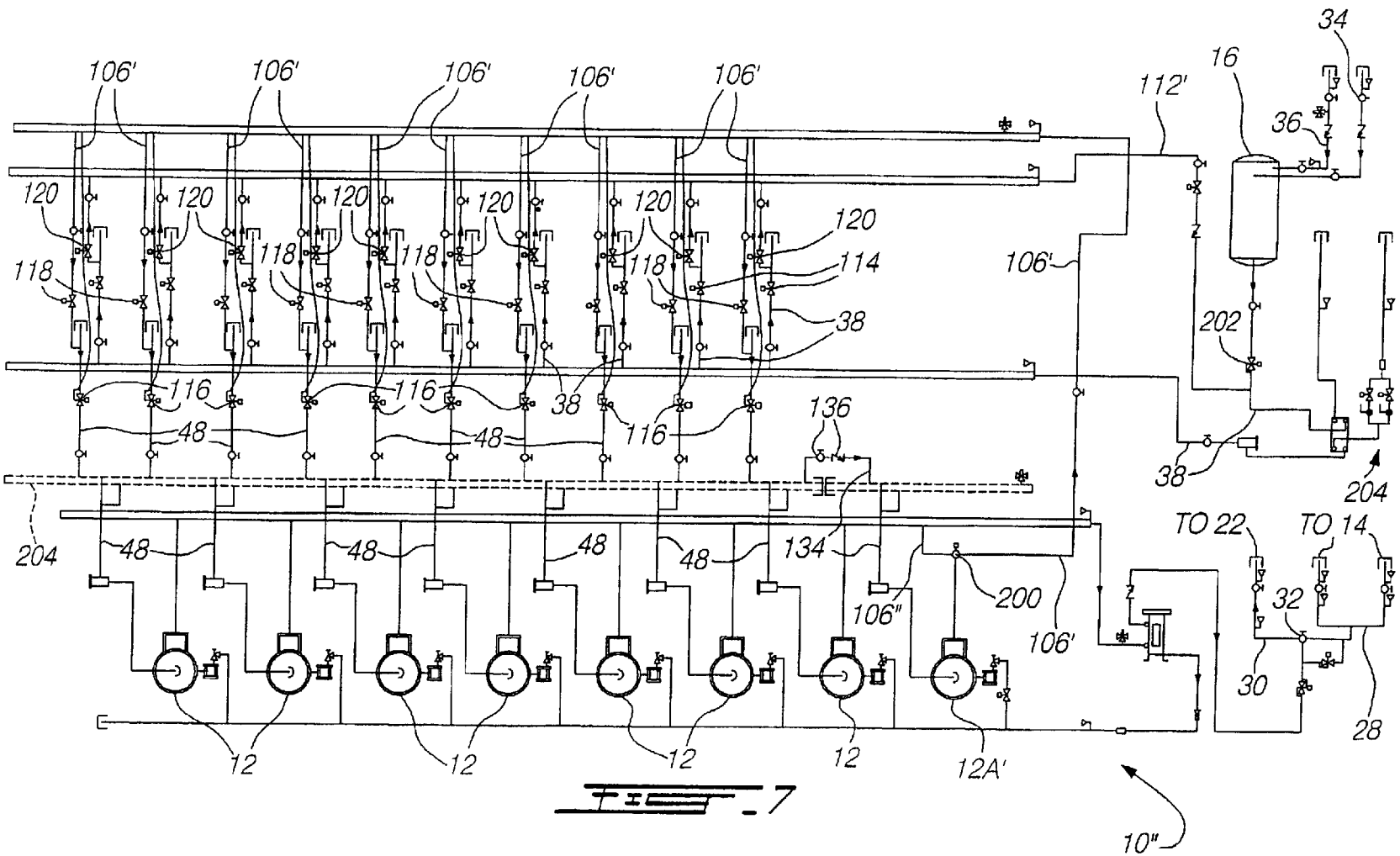
FIG. 7 is a schematic view showing the refrigeration system of FIG. 6.

Referring to FIGS. 6 and 7, another configuration of the refrigeration system 10" is shown, wherein gas refrigerant is sent to defrost the evaporators 20 at a lower pressure than gas refrigerant sent to the condensing stage. The dedicated compressor 12A' collects low pressure gas refrigerant from a suction header 204 that also supplies the other compressors 12 in refrigerant. However, the compressor 12A' is the only compressor supplying evaporators in defrost cycles, whereby its discharge pressure can be lowered. This is performed by having line 106' connected to the evaporators 20 by valve 116 closing to direct refrigerant via line 48 thereto (shown connected to only one line 48 in FIG. 6 but obviously connected to all lines 48 of all evaporators 20 requiring defrost). A portion of the refrigerant discharged by the compressor 12A' can be sent to the condensing stage, via line 106" that converges with the line 28. A valve 200 (e.g., a three-way modulating valve), controls the portions of refrigerant discharge going to the lines 106' and 106".

Thereafter, the refrigerant exiting from the defrosted evaporators 20 is injected into the evaporators 20 in a refrigeration cycle. Line 112' collects liquid refrigerant exiting from the evaporators 20 in defrost, and converges with the line 38 upstream of the expansion valves 18, such that the liquid refrigerant can be injected in the evaporators 20 in the refrigeration cycle. A valve 202 (e.g., pressure regulating valve) ensures that a proper refrigerant pressure is provided to the line 38, and compensates a lack of refrigerant pressure by transferring liquid refrigerant from the high pressure reservoir 16 to the line 38. The combination of the dedicated compressor 12A' (i.e., low pressure refrigerant feed to the defrost evaporators, also achievable by the refrigeration system of FIG. 1) and the valve 202 enable the injection of low pressure refrigerant, which exits from the defrost cycle, in the evaporator units 17. Previously, reinjected defrost refrigerant had to be conveyed to the condensing stage to reach adequate conditions to be reinjected into the evaporation cycles. As seen in FIG. 7, a subcooling system 204 can be used to ensure the proper state of the refrigerant reaching the evaporator units 17. With the refrigeration system 10" of FIGS. 6 and 7, the defrost refrigerant can be reinjected in the evaporator units 17 at pressures as low as 120 to 140 Psi for refrigerant 22, and 140 to 160 Psi for refrigerant 507 and refrigerant 404, even though the refrigerant 22 is up to about 220 to 260 Psi in the condenser units 14, and the refrigerant 507 and the refrigerant 404 are up to about 250 to 340 Psi.

Although the refrigeration system 10 of the present invention enables the defrosting of the evaporators 20 at high pressure, it is preferable that the pressure regulator 108 reduce the pressure of the refrigerant fed to the evaporators 20 in defrost cycles. In such a case, less refrigerant is required to defrost an evaporator, whereby a plurality of evaporators 20 can be defrosted simultaneously.

It is within the ambit of the present invention to cover any obvious modifications of the embodiments described herein, provided such modifications fall within the scope of the appended claims.

What is claimed is:

1. A defrost refrigeration system of the type having a main refrigeration circuit, wherein a refrigerant goes through at least a compressing stage, wherein said refrigerant is compressed to a high-pressure gas state to then reach a condensing stage, wherein said refrigerant in said high-pressure gas state is condensed at least partially to a high-pressure liquid state to then reach an expansion stage, wherein said refrigerant in said high-pressure liquid state is expanded to a first low-pressure liquid state to then reach an evaporator stage, wherein said refrigerant in said first low-pressure liquid state is evaporated at least partially to a first low-pressure gas state by absorbing heat, to then return to said compressing stage, said defrost refrigeration system comprising a first line extending from the compressing stage to the evaporator stage and adapted to receive a portion of said refrigerant in said high-pressure gas state, a first pressure regulating device on the first line for reducing a pressure of said portion of said refrigerant in said high-pressure gas state to a second low-pressure gas state, valves for stopping a flow of said refrigerant in said first low-pressure liquid state to at least one evaporator of the evaporator stage and directing a flow of said refrigerant in said second low-pressure gas state to release heat to defrost the at least one evaporator and thereby changing phase at least partially to a second low-pressure liquid state, and a second line for directing said refrigerant having released heat to at least one of the compressing stage, the condensing stage and the evaporator, stage.

2. The defrost refrigeration system according to claim 1, wherein said refrigerant in said second low-pressure liquid state is accumulated in a reservoir, the reservoir being connected to the compressing stage and the condensing stage by the second line.

3. The defrost refrigeration system according to claim 2, wherein refrigerant directed from the reservoir to the compressing stage is a portion of said refrigerant in said second low-pressure liquid state evaporated in said reservoir to a third low-pressure gas state.

4. The defrost refrigeration system according to claim 2, wherein said refrigerant in said second low-pressure state accumulated in said reservoir is directed to one of upstream and downstream of the condensing stage.

5. The defrost refrigeration system according to claim 4, wherein said refrigerant is directed to the condensing stage by a pressure differential being created between the compressing stage and the condensing stage by a second pressure regulating device, said refrigerant in said second low-pressure liquid state being mixed with said refrigerant in said high-pressure gas state exiting from said compressing stage to be entrained to the condensing stage.

6. The defrost refrigeration system according to claim 5, wherein the compressing stage has at least two compressors, only one of said at least two compressors receiving said portion of said refrigerant in said second low-pressure liquid state evaporated in said reservoir to said third low-pressure gas state.

7. A method for defrosting evaporators of a refrigeration system of the type having a main refrigeration circuit, wherein a refrigerant goes through at least a compressing stage, wherein said refrigerant is compressed to a high-pressure gas state to then reach a condensing stage, wherein said refrigerant in said high-pressure gas state is condensed at least partially to a high-pressure liquid state to then reach an expansion stage, wherein said refrigerant in said high-pressure liquid state is expanded to a first low-pressure liquid state to then reach an evaporator stage, wherein said refrigerant in said first low-pressure liquid state is evaporated at least partially to a first low-pressure gas state by absorbing heat, to then return to said compressing stage, comprising the steps of:

i) stopping a flow of said refrigerant in said first low-pressure liquid state to at least one evaporator of the evaporator stage, while other evaporators of the evaporator stage remain in a refrigeration cycle;

ii) regulating a pressure of a portion of said refrigerant in said high-pressure gas state to a second low-pressure gas state; and iii) directing said portion of said refrigerant in said second low-pressure gas state to the at least one evaporator to release heat to defrost the at least one evaporator and thereby changing phase at least partially to a second low-pressure liquid state.

8. The method according to claim 7, further comprising a step iv) of directing said refrigerant having released heat to at least one of the compressing stage and the condensing stage.

* * * * *